US011353027B2

(12) United States Patent
Kim et al.

(10) Patent No.: US 11,353,027 B2
(45) Date of Patent: Jun. 7, 2022

(54) COMPRESSOR HAVING BYPASSING PORTION

(71) Applicant: LG Electronics Inc., Seoul (KR)

(72) Inventors: Taekyoung Kim, Seoul (KR); Kangwook Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 156 days.

(21) Appl. No.: 16/791,511

(22) Filed: Feb. 14, 2020

(65) Prior Publication Data

US 2020/0263692 A1 Aug. 20, 2020

(30) Foreign Application Priority Data

Feb. 15, 2019 (KR) ..... 10-2019-0017612

(51) Int. Cl.

*F04C 29/02* (2006.01)
*F04C 14/26* (2006.01)
*F04C 29/12* (2006.01)

(52) U.S. Cl.

CPC ..... *F04C 29/026* (2013.01); *F04C 29/021* (2013.01); *F04C 29/028* (2013.01); *F04C 29/124* (2013.01)

(58) Field of Classification Search

CPC .... F04C 29/026; F04C 29/021; F04C 29/028; F04C 29/02; F04C 14/26

See application file for complete search history.

(56) References Cited

U.S. PATENT DOCUMENTS

2009/0110586 A1* 4/2009 Brabek ..... F04C 29/04 418/179
2015/0159649 A1* 6/2015 Koyama ..... F04B 39/04 417/410.5
2020/0232687 A1* 7/2020 Guo ..... F04B 53/18

FOREIGN PATENT DOCUMENTS

| | | |
|---|---|---|
| EP | 1233187 | 8/2002 |
| JP | S6213786 | 1/1987 |
| JP | 2002235666 | 8/2002 |
| JP | 2005330821 | 12/2005 |
| JP | 2006077700 | 3/2006 |
| JP | 6344452 | 6/2018 |

(Continued)

OTHER PUBLICATIONS

Korean Office Action in Korean Application No. 10-2019-0017612, dated Apr. 21, 2020, 14 pages (with English translation).

(Continued)

*Primary Examiner* — Deming Wan
(74) *Attorney, Agent, or Firm* — Fish & Richardson P.C.

(57) ABSTRACT

A compressor includes a casing configured to accommodate refrigerant and oil, a discharger disposed at a side of the casing and configured to discharge the refrigerant, a driver including a stator and a rotor, a rotation shaft that is coupled to the rotor and that extends in a direction away from the discharger, a compressing assembly that is coupled to the rotation shaft, that is configured to be lubricated with the oil, and that is configured to compress the refrigerant and discharge the compressed refrigerant in the direction away from the discharger, a muffler coupled to the compressing assembly and configured to guide the refrigerant to the discharger, and a bypassing portion disposed outside the casing and configured to transfer the refrigerant or the oil from the muffler to the discharger.

18 Claims, 7 Drawing Sheets

(56) References Cited

FOREIGN PATENT DOCUMENTS

| | | |
|---|---|---|
| KR | 200224364 | 5/2001 |
| KR | 10-2018-0124633 | 11/2018 |
| KR | 10-2018-0124636 | 11/2018 |
| KR | 1020190001071 | 1/2019 |

OTHER PUBLICATIONS

Extended European Search Report in European Appln. No. 20157316.9, dated Jun. 19, 2020, 7 pages.
KR Office Action in Korean Appln. No. 10-2020-0182854, dated Feb. 3, 2021, 15 pages (with English translation).

* cited by examiner

COMPRESSOR HAVING BYPASSING PORTION

CROSS-REFERENCE TO RELATED APPLICATIONS

This application claims priority to and the benefit of Korean Patent Application No. 10-2019-0017612, filed on Feb. 15, 2019, which is hereby incorporated by reference as if fully set forth herein.

TECHNICAL FIELD

The present disclosure relates to a compressor. More specifically, the present disclosure relates to a scroll type compressor capable of bypassing refrigerant compressed by a compressing assembly for delivery to a discharger.

BACKGROUND

A compressor may perform a refrigeration cycle for a refrigerator or an air conditioner. For example, the compressor may compress refrigerant to provide work necessary to generate heat exchange in the refrigeration cycle.

The compressors may be classified into a reciprocating type compressor, a rotary type compressor, and a scroll type compressor based on a scheme for compressing the refrigerant. The scroll type compressor may perform an orbiting motion by engaging an orbiting scroll with a fixed scroll fixed in an internal space of a sealed container to define a compression chamber between a fixed wrap of the fixed scroll and an orbiting wrap of the orbiting scroll.

In some cases, the scroll type compressor may obtain a relatively high compression ratio because the refrigerant may be continuously compressed through the scrolls engaged with each other, and may obtain a stable torque because suction, compression, and discharge of the refrigerant may proceed smoothly. The scroll type compressor may be used for compressing the refrigerant in the air conditioner and the like.

In some cases, the scroll type compressor may have difficulty in supplying oil into a compression assembly that is disposed above a driver and that is close to a discharger. In some cases, the scroll type compressor may include an additional a lower frame to separately support a rotation shaft connected to the compression assembly below the driver. In some cases, the scroll type compressor may have mismatch between points of applications of a gas force generated by the refrigerant inside the compressor and of a reaction force supporting the gas force, which may tilt the scroll and reduce an efficiency and a reliability thereof.

In some cases, a scroll type compressor (or a lower scroll type compressor) may have a driver below the discharger and a compression assembly below the driver.

In the lower scroll type compressor, the driver may be disposed closer to the discharger than the compression assembly, and the compression assembly may be disposed farthest away from the discharger.

In some cases, one end of the rotation shaft may be connected to the driver and the other end thereof may be supported by the compression assembly, thereby omitting the lower frame, and the oil stored in an oil storage space defined at a lower portion of the casing may be directly supplied to the compression assembly without passing the driver. In addition, in the lower scroll type compressor, when the rotation shaft is connected through the compression assembly, the point of applications of the gas force and the reaction force match on the rotation shaft to offset a vibration and a tilting moment of the scroll, thereby ensuring the efficiency and the reliability thereof.

FIGS. 1A and 1B illustrate a scroll type compressor in related art.

Referring to FIG. 1A, a lower scroll type compressor includes a driver 1200 that is disposed closer to a discharger 1121 than a compression assembly 1300, where the compression assembly 1300 is disposed farthest away from the discharger 1121. The lower scroll type compressor may include a rotation shaft 1230 that has one end connected to the driver 1200 and the other end thereof supported by the compression assembly 1300. In some cases, a separate lower frame for supporting the rotation shaft may be omitted, and the oil stored in an oil storage space defined at one side of the casing may be directly supplied to the compression assembly 1300 through the rotation shaft 1230 without passing the driver 1200.

In some cases, where the rotation shaft 1230 is connected through the compression assembly 1300, the point of applications of the gas force and the reaction force match on the rotation shaft 1230 to offset the vibration and the tilting moment of the scroll in the compression assembly 1300.

In some cases, the oil supplied to the compression assembly 1300 through the rotation shaft 1230 lubricates an inside of the compression assembly 1300 and simultaneously cools the compression assembly 1300 to prevent wear and overheating of the compressing assembly 300. In some cases, where the oil supplied to the compression assembly 1300 is diluted with the refrigerant, when the refrigerant is discharged from the compression assembly 1300 and passes through the driver 1200, the oil may flow towards the discharger 1121 together with the refrigerant.

In some cases, the compressed refrigerant and oil exist together in a space between the driver 1200 and the discharger 1121. The oil may have a density and a viscosity greater than those of the refrigerant, so the oil may be collected again to the oil storage space of the casing through a collection channel (d-cut) defined in outer circumferential faces of the driver and the compression assembly, and the refrigerant is discharged through the discharger 1121.

In some cases, when a rate at which the refrigerant is discharged to the discharger 1121 is high or a pressure of the refrigerant is high, the oil may be unintentionally discharged to the discharger 1121 together with the refrigerant. When the oil is discharged to the discharger 1121, because the oil is circulated throughout the refrigerant cycle to which the compressor is connected, a reliability or an efficiency of the refrigerant cycle is reduced. In some cases, where the oil is not collected into the casing 1100, the oil that lubricates or cools the compression assembly 1300 may be reduced, a friction loss of the compression assembly may occur, the compression assembly 1300 may be worn, or the compression assembly 1300 may be overheated.

In some cases, the lower scroll type compressor has a space where the compression assembly 1300 is not disposed between the driver 1200 and the discharger 1121. Therefore, the lower scroll type compressor may be able to prevent the oil from flowing to the discharger 1121 by installing an oil separating member in the space between the driver 1200 and the discharger 1121 to separate the oil from the refrigerant.

Referring to FIG. 1A, the oil separating member may include a filter-type separating member that separates the refrigerant and the oil by a density difference therebetween by inducing collision between oil particles (a demister-type or a mesh-type oil member 1610 or 1620). The filter-type separating member may be composed of a plate 1610 having a disc or cone shape and having a through-hole defined therein and a filter member 1620 coupled to the through-hole.

The plate 1610 is provided to collect the oil and the refrigerant passed through the driver 1200 to the filter member 1620, and then guide the oil separated from the filter member 1620 back to the oil storage space of the casing. The filter member 1620 is provided with a filter of a porous material for being in contact with or passing the oil and the refrigerant guided along the plate 1610. Because the refrigerant is in a gaseous state, the refrigerant passes through the filter member 1620 as it is. However, because the oil is in a particulate droplet state, the oil is adsorbed to the filter member 1620 and grows into a large droplet. Thereafter, the oil remains in the filter member 1620 due to a density difference, and the remaining oil flows along the plate 1610 by a weight thereof and is collected into the oil storage space of the casing.

In some cases, the more the oil collides with the filter member 1620, the more the oil is collected, so that the faster the rate of the oil flowing into the filter member 1620 or the greater the weight (or the density), the better. However, the high flow rate of the oil means that the flow rate of the refrigerant is high, and this means that the refrigerant is compressed at a higher pressure, so that it may mean that a pressure difference is very large in front of and behind the filter member 1620 and in front of and behind the discharger 1121. Therefore, the oil adsorbed to the filter member 1620 receives a force for separating the oil from the filter member 1620 again by the pressure difference or a pressure drop, thereby causing an adverse effect of the oil flowing out to the discharger 1121 together with the refrigerant.

In some cases, in the filter-type separating member, when the compression assembly 1300 compresses the refrigerant at a high speed, the separation efficiency drops drastically, so that, when the compressor is operated at a high speed (e.g., 90 Hz or above), the oil separation efficiency decreases rapidly.

In some cases, an oil separating member may use a centrifugal separation method.

Referring to FIG. 1B, the oil separating member may be formed as a centrifugal separating member 1630 coupled to the driver 1200 and rotating together with the rotation shaft 1230 or the rotor 1220.

The centrifugal separating member may rotate strongly to generate a centrifugal force on oil particles. Thereafter, the oil particles collide with each other to grow into a large droplet, and oil of the large droplet is subjected to a greater centrifugal force, so that the oil of the large droplet may collide with an inner wall of the casing and be separated from the refrigerant.

In some cases, the higher the speed, the greater the centrifugal force, so that the oil separation efficiency may be higher when the compressor compresses the refrigerant at a high speed. Thus, the centrifugal separating member is suitable for driving the compressor at a high speed.

In some cases, in the scroll type compressor having the centrifugal separating member 1630 as shown in FIG. 1B, the refrigerant and the oil discharged from the compression assembly 1300 may pass through the compression assembly 1300 and the driver 1200 to reach the discharger 1121. Therefore, the scroll type compressor may have a structural limitation in which a flow speed of the refrigerant and the oil that may be reduced due to the friction thereof against the compression assembly 1300 and the driver 1200.

In some cases, when the compressor is driven at a high speed, the friction between the refrigerant and the oil and the compression assembly 1300 and the driver 1200 may be more intensive, thus causing the speed to decelerate.

In some case, the centrifugal separating member 1630 may not exert a sufficient centrifugal force on the oil, thereby causing the oil to fail to be separated from the refrigerant and, rather, causing the oil to be discharged together with the refrigerant.

SUMMARY

The present disclosure describes a compressor that may reduce the frictional loss by delivering the compressed refrigerant toward the discharger in a bypassing manner.

The present disclosure describes a compressor equipped with a novel separate channel for supplying the compressed refrigerant and the oil directly to a separator installed to separate the oil from the compressed refrigerant.

The present disclosure describes a compressor in which a conventional channel through which the refrigerant and oil may flow and the novel separate channel may be installed together, such that the compressing assembly and the driver may be cooled down using conventional oil.

The present disclosure describes a compressor that may maintain a speed of the oil by preventing the oil in the compressed refrigerant from rubbing against other parts inside the casing.

The present disclosure describes a compressor that may maintain a speed of the oil to maximize centrifugation efficiency.

The present disclosure describes a compressor that may increase compressor efficiency by preventing the compressed refrigerant from rubbing against other components inside the casing.

Purposes are not limited to the above-mentioned purpose. Other purposes and advantages as not mentioned above may be understood from following descriptions and more clearly understood from implementations. Further, it will be readily appreciated that the purposes and advantages may be realized by features and combinations thereof as disclosed in the claims.

In some implementations, a scroll type compressor in accordance with the present disclosure may include an external pipe structure for more actively utilizing a built-in oil separation structure. For example, a separator for centrifuging oil may be installed in a space between a driver of the compressor and a casing, and the external pipe structure may be configured to supply refrigerant and oil to the separator.

The external pipe may be configured to inject the refrigerant and oil in a direction approximate to a tangential direction with an outer surface of the casing rather than to inject the refrigerant and oil into a center of rotation of the separator.

In some examples, the external pipe may be configured to supply the refrigerant and oil into a position between the driver and one end of the separator so that a centrifugal force from the separator may be applied to the refrigerant and oil as soon as the refrigerant and oil are supplied thereto.

In some examples, the external pipe may have one end fixed to a muffler which contacts the refrigerant discharged directly from the compressing assembly, and the other end coupled to the casing. In some cases, in order that the external pipe does not detach from the casing or the muffler due to a friction or reaction force as caused when the refrigerant or oil flows through the external pipe, the external pipe may have a separate fixing member which is coupled to an inner or outer wall of the muffler or the casing.

Further, the compressor in accordance with the present disclosure may include a separate flow channel passing through the driver and the compressing assembly in addition to the external pipe. The refrigerant discharged to the muffler may flow along the flow channel. Thus, the compressed refrigerant discharged from the compressing assembly and the oil may flow into the external pipe and the flow channel in a divided manner.

In some examples, the external pipe may have a damper to adjust an inflow amount of the oil and refrigerant. The damper may be configured to be actively controlled by a controller.

The external pipe may be referred to as bypassing portion because the external pipe serves to transport the oil and refrigerant to the separator in which the refrigerant and the oil are separated from each other.

That is, the bypassing portion may supply the refrigerant and oil discharged to the muffler to at least one of the separator or the discharger.

According to one aspect of the subject matter described in this application, a compressor includes a casing that is configured to accommodate refrigerant and that defines a reservoir space configured to store oil, where the casing includes a discharger disposed at a side of the casing and configured to discharge the refrigerant, a driver including a stator coupled to an inner circumferential surface of the casing and configured to generate a rotating magnetic field, and a rotor accommodated in the stator and configured to rotate relative to the stator based on the rotating magnetic field, a rotation shaft that is coupled to the rotor and that extends in a direction away from the discharger, a compressing assembly that is coupled to the rotation shaft, that is configured to be lubricated with the oil, and that is configured to compress the refrigerant and discharge the compressed refrigerant in the direction away from the discharger, a muffler coupled to the compressing assembly and configured to guide the refrigerant to the discharger, and a bypassing portion disposed outside the casing and configured to transfer the refrigerant or the oil from the muffler to the discharger.

Implementations according to this aspect may include one or more of the following features. For example, the compressor may further include a separator that is disposed between the discharger and the driver and that is configured to separate the oil from the refrigerant supplied to the discharger, and the bypassing portion may be configured to supply the refrigerant or the oil from the muffler to at least one of the separator or the discharger. In some examples, the bypassing portion may be coupled to an outer circumferential surface of the casing and configured to discharge the refrigerant or the oil to a position between (i) a radial line that extends from the outer circumferential surface of the casing to the rotation shaft and (ii) a tangential line that is tangential to the outer circumferential surface of the casing.

In some implementations, the bypassing portion may be coupled to the casing and configured to discharge the refrigerant or the oil into a position between a vertical level of the driver and a vertical level of the side of the casing at which the discharger is coupled. In some examples, the bypassing portion may be coupled to the casing and configured to discharge the refrigerant or the oil into a space between the driver and a free end of the separator.

In some implementations, the muffler may be configured to receive the refrigerant or the oil through the compressing assembly and the driver and to supply the refrigerant or the oil to the bypassing portion.

In some implementations, the bypassing portion may include a first pipe coupled to the muffler, a second pipe that is in communication with the first pipe, that is disposed outside of the casing, and that extends to the discharger, and a third pipe that is in communication with the second pipe and that is coupled to the casing. In some examples, the first pipe may pass through the casing. In some examples, the bypassing portion may further include a muffler fastener that couples a distal end of the first pipe to the muffler.

In some examples, the muffler fastener may include a seat that is in contact with an inner wall of the muffler and that extends from an outer circumferential surface of the first pipe or is coupled to the first pipe. In some examples, the muffler fastener may include a close contact portion that is in contact with an outer wall of the muffler and that extends from an outer circumferential surface of the first pipe or is coupled to the first pipe.

In some examples, the muffler fastener may include a seat that is in contact with an inner wall of the muffler and that extends from an outer circumferential surface of the first pipe or is coupled to the first pipe, and a close contact portion that is in contact with an outer wall of the muffler and that extends from the outer circumferential surface of the first pipe or is coupled to the first pipe.

In some implementations, the muffler may include a receiving body that defines a refrigerant flow space therein configured to receive the refrigerant and that defines an outlet hole configured to discharge the refrigerant to the first pipe, and a coupling body that extends along an outer circumferential surface of the receiving body and that is coupled to the compressing assembly. In some examples, the receiving body may include a guide that protrudes radially outward from the outer circumferential surface of the receiving body and that is configured to guide the refrigerant discharged from the compressing assembly to the discharger, and the outlet hole passes through the guide.

In some implementations, the coupling body may define a muffler collection channel that is recessed from an outer circumferential surface of the coupling body and that is configured to discharge the oil separated from the refrigerant toward the reservoir space, and the outlet hole may be offset from the muffler collection channel and configured to discharge the refrigerant bypassing the muffler collection channel.

In some implementations, the bypassing portion further may include a casing fastener that couples a distal end of the third pipe to the casing. In some examples, the casing fastener may include a seat that is in contact with an inner wall of the casing and that extends from an outer circumferential surface of the third pipe or is coupled to the third pipe. In some examples, the casing fastener may include a close contact portion that is in contact with an outer wall of the casing and that extends from an outer circumferential surface of the third pipe or is coupled to the third pipe.

In some implementations, the casing fastener may include a seat that is in contact with an inner wall of the casing and that extends from an outer circumferential surface of the third pipe or is coupled to the third pipe, and a close contact portion that is in contact with an outer wall of the casing and that extends from the outer circumferential surface of the third pipe or is coupled to the third pipe. In some examples, the bypassing portion further may include a first connection pipe that extends from the first pipe, that is inclined with respect to the first pipe toward the discharger, and that is connected to the second pipe, and a second connection pipe that extends from a distal end of the second pipe, that is inclined with respect to the second pipe toward the casing, and that is connected to the third pipe.

In some implementations, the outlet hole may bypass an oil collection channel defined in an outer surface of the muffler or may be spaced from the collection channel. Thus, the bypassing portion may be prevented from interfering with the collection channel.

The features of the above-described implantations may be combined with other implementations as long as they are not contradictory or exclusive to each other.

The present disclosure may have an effect of providing a compressor that may reduce the frictional loss by delivering the compressed refrigerant toward the discharger in a bypassing manner.

In some implementations, the compressor may be equipped with a novel separate channel for supplying the compressed refrigerant and the oil directly to a separator installed to separate the oil from the compressed refrigerant.

In some implementations, the compressor may include a channel through which the refrigerant and oil flow and the novel separate channel, such that the compressing assembly and the driver may be cooled down using conventional oil.

In some implementations, the compressor may maintain a speed of the oil by preventing the oil in the compressed refrigerant from rubbing against other parts inside the casing.

In some implementations, the compressor may maintain a speed of the oil to maximize centrifugation efficiency.

In some implementations, the compressor may increase compressor efficiency by preventing the compressed refrigerant from rubbing against other components inside the casing.

Effects are not limited to the above effects. Those skilled in the art may readily derive various effects from various configurations.

DETAILED DESCRIPTIONS

The same reference numbers in different figures denote the same or similar elements, and as such perform similar functionality. Furthermore, in the following detailed description, numerous specific details are set forth in order to provide a thorough understanding. However, it will be understood that the present disclosure may be practiced without these specific details. In other instances, well-known methods, procedures, components, and circuits have not been described in detail so as not to unnecessarily obscure aspects.

Figure 1A:
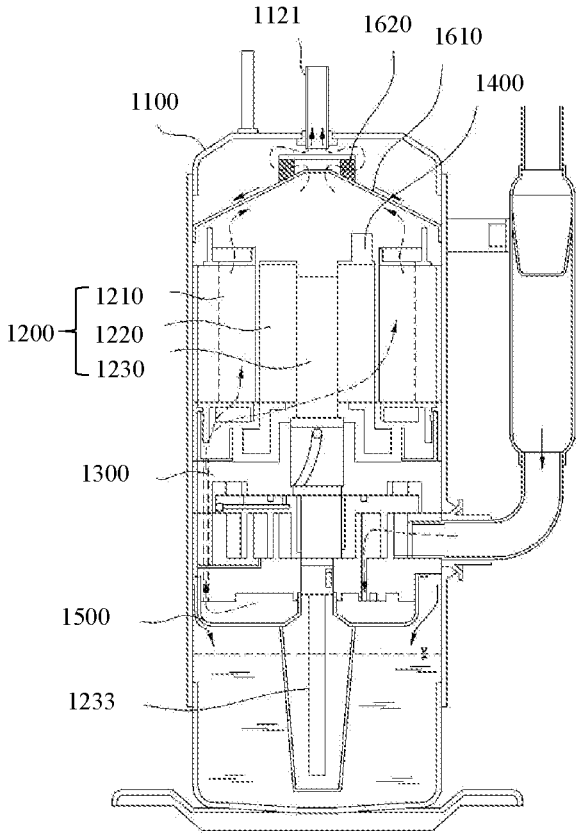
FIGS. 1A and 1B illustrate scroll type compressors in related art.
Figure 1B:
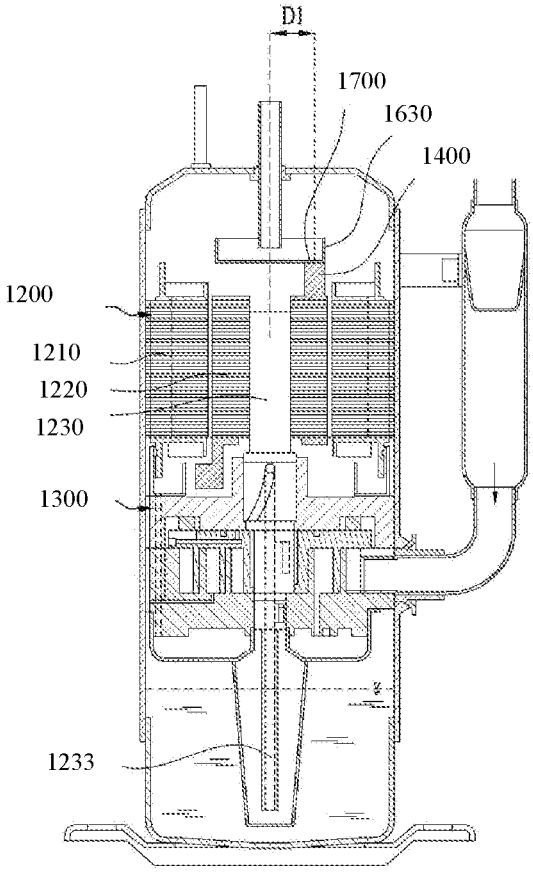
FIG. 1B RELATED ART
Figure 2:
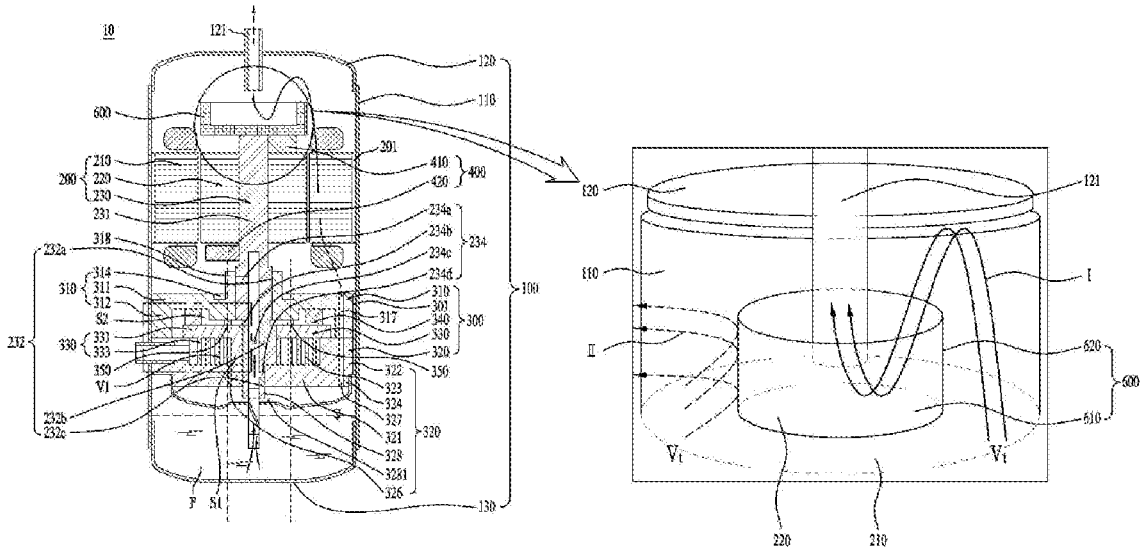
FIG. 2 illustrates an example of a compressor according to the present application.

Referring to FIG. 2, a scroll type compressor 10 may include a casing 100 having therein a space in which fluid is stored or flows, a driver 200 coupled to an inner circumferential surface of the casing 100 to rotate a rotation shaft 230, and a compressing assembly 300 coupled to the rotation shaft 230 inside the casing and compressing the fluid.

In some implementations, the casing 100 may include a discharger 121 through which refrigerant is discharged at one side. The casing 100 may include a receiving shell 110 provided in a cylindrical shape to receive the driver 200 and the compressing assembly 300 therein, a discharge shell 120 coupled to one end of the receiving shell 110 and having the discharger 121, and a sealing shell 130 coupled to the other end of the receiving shell 110 to seal the receiving shell 110. In some examples, the discharger 121 may include a pipe or a tube connected to the casing 100.

The driver 200 includes a stator 210 for generating a rotating magnetic field, and a rotor 220 disposed to rotate by the rotating magnetic field. The rotation shaft 230 may be coupled to the rotor 220 to be rotated together with the rotor 220. In some examples, the driver 200 may be a motor including a stator and a rotor. In some examples, the driver 200 may include one or more gears configured to transfer rotating force to the rotation shaft 230.

In some examples, the stator 210 has a plurality of slots defined in an inner circumferential surface thereof along a circumferential direction and a coil is wound around the plurality of slots. Further, the stator 210 may be fixed to an inner circumferential surface of the receiving shell 110. A permanent magnet may be coupled to the rotor 220, and the rotor 220 may be rotatably coupled within the stator 210 to generate rotational power. The rotation shaft 230 may be pressed into and coupled to a center of the rotor 220.

The compressing assembly 300 may include a fixed scroll 320 coupled to the receiving shell 110 and disposed in a direction away from the discharger 121 with respect to the driver 200, an orbiting scroll 330 coupled to the rotation shaft 230 and engaged with the fixed scroll 320 to define a compression chamber, and a main frame 310 accommodating the orbiting scroll 330 therein and seated on the fixed scroll 320 to form an outer shape of the compressing assembly 300.

In some implementations, the lower scroll type compressor 10 has the driver 200 disposed between the discharger 121 and the compressing assembly 300. In other words, the driver 200 may be disposed at one side of the discharger 121, and the compressing assembly 300 may be disposed in a direction away from the discharger 121 with respect to the driver 200. For example, when the discharger 121 is disposed on the casing 100, the compressing assembly 300 may be disposed below the driver 200, and the driver 200 may be disposed between the discharger 121 and the compressing assembly 300.

Thus, when oil is stored in an oil storage space p of the casing 100, the oil may be supplied directly to the compressing assembly 300 without passing through the driver 200. In addition, since the rotation shaft 230 is coupled to and supported by the compressing assembly 300, a lower frame for rotatably supporting the rotation shaft may be omitted.

In some examples, the lower scroll type compressor 10 may be provided such that the rotation shaft 230 penetrates not only the orbiting scroll 330 but also the fixed scroll 320 to be in surface contact with both the orbiting scroll 330 and the fixed scroll 320.

In some implementations, an inflow force generated when the fluid such as the refrigerant is flowed into the compressing assembly 300, a gas force generated when the refrigerant is compressed in the compressing assembly 300, and a reaction force for supporting the same may be directly exerted on the rotation shaft 230. Accordingly, the inflow force, the gas force, and the reaction force may be exerted to a point of application of the rotation shaft 230. In some examples, since a tilting moment does not act on the orbiting scroll 320 coupled to the rotation shaft 230, tilting or overturn of the orbiting scroll may be blocked. In other words, tilting in an axial direction of the tilting may be attenuated or prevented, and the overturn moment of the orbiting scroll 330 may also be attenuated or suppressed. In some implementations, noise and vibration generated in the lower scroll type compressor 10 may be blocked.

In some examples, the fixed scroll 320 may be in surface contact with and supports the rotation shaft 230, so that durability of the rotation shaft 230 may be reinforced even when the inflow force and the gas force act on the rotation shaft 230.

In some examples, a backpressure generated while the refrigerant is discharged to outside is also partially absorbed or supported by the rotation shaft 230, so that a force (normal force) in which the orbiting scroll 330 and the fixed scroll 320 become excessively close to each other in the axial direction may be reduced. In some implementations, a friction force between the orbiting scroll 330 and the fixed scroll 320 may be greatly reduced.

In some implementations, the compressor 10 attenuates the tilting in the axial direction and the overturn or tilting moment of the orbiting scroll 330 inside the compressing assembly 300 and reduces the frictional force of the orbiting scroll, thereby increasing an efficiency and a reliability of the compressing assembly 300.

In some examples, the main frame 310 of the compressing assembly 300 may include a main end plate 311 provided at one side of the driver 200 or at a lower portion of the driver 200, a main side plate 312 extending in a direction farther away from the driver 200 from an inner circumferential surface of the main end plate 311 and seated on the fixed scroll 330, and a main shaft receiving portion 318 extending from the main end plate 311 to rotatably support the rotation shaft 230.

A main hole 317 for guiding the refrigerant discharged from the fixed scroll 320 to the discharger 121 may be further defined in the main end plate 311 or the main side plate 312.

The main end plate 311 may further include an oil pocket 314 that is engraved in an outer surface of the main shaft receiving portion 318. The oil pocket 314 may be defined in an annular shape, and may be defined to be eccentric to the main shaft receiving portion 318. When the oil stored in the sealing shell 130 is transferred through the rotation shaft 230 or the like, the oil pocket 314 may be defined such that the oil is supplied to a portion where the fixed scroll 320 and the orbiting scroll 330 are engaged with each other.

The fixed scroll 320 may include a fixed end plate 321 coupled to the receiving shell 110 in a direction away from the driver 200 with respect to the main end plate 311 to form the other surface of the compressing assembly 300, a fixed side plate 322 extending from the fixed end plate 321 to the discharger 121 to be in contact with the main side plate 312, and a fixed wrap 323 disposed on an inner circumferential surface of the fixed side plate 322 to define the compression chamber in which the refrigerant is compressed.

In some examples, the fixed scroll 320 may include a fixed through-hole 328 defined to penetrate the rotation shaft 230, and a fixed shaft receiving portion 3281 extending from the fixed through-hole 328 such that the rotation shaft is rotatably supported. The fixed shaft receiving portion 3331 may be disposed at a center of the fixed end plate 321.

A thickness of the fixed end plate 321 may be equal to a thickness of the fixed shaft receiving portion 3381. In this case, the fixed shaft receiving portion 3281 may be inserted into the fixed through-hole 328 instead of protruding from the fixed end plate 321.

The fixed side plate 322 may include an inflow hole 325 defined therein for flowing the refrigerant into the fixed wrap 323, and the fixed end plate 321 may include discharge hole 326 defined therein through which the refrigerant is discharged. The discharge hole 326 may be defined in a center direction of the fixed wrap 323, or may be spaced apart from the fixed shaft receiving portion 3281 to avoid interference with the fixed shaft receiving portion 3281, or the discharge hole 326 may include a plurality of discharge holes.

The orbiting scroll 330 may include an orbiting end plate 331 disposed between the main frame 310 and the fixed scroll 320, and an orbiting wrap 333 disposed below the orbiting end plate to define the compression chamber together with the fixed wrap 323 in the orbiting end plate.

The orbiting scroll 330 may further include an orbiting through-hole 338 defined through the orbiting end plate 331 to rotatably couple the rotation shaft 230.

The rotation shaft 230 may be disposed such that a portion thereof coupled to the orbiting through-hole 338 is eccentric. Thus, when the rotation shaft 230 is rotated, the orbiting scroll 330 moves in a state of being engaged with the fixed wrap 323 of the fixed scroll 320 to compress the refrigerant.

Specifically, the rotation shaft 230 may include a main shaft 231 coupled to the driver 200 and rotating, and a bearing 232 connected to the main shaft 231 and rotatably coupled to the compressing assembly 300. The bearing 232 may be included as a member separate from the main shaft 231, and may accommodate the main shaft 231 therein, or may be integrated with the main shaft 231.

The bearing 232 may include a main bearing **232*c* inserted into the main shaft receiving portion 318 of the main frame 310 and rotatably supported, a fixed bearing 232*a* inserted into the fixed shaft receiving portion 3281 of the fixed scroll 320 and rotatably supported, and an eccentric shaft 232*b* disposed between the main bearing 232*c* and the fixed bearing 232*a*, and inserted into the orbiting through-hole 338 of the orbiting scroll 330** and rotatably supported.

In some implementations, the main bearing **232*c* and the fixed bearing 232*a* may be coaxial to have the same axis center, and the eccentric shaft 232*b* may be formed such that a center of gravity thereof is radially eccentric with respect to the main bearing 232*c* or the fixed bearing 232*a*. In addition, the eccentric shaft 232*b* may have an outer diameter greater than an outer diameter of the main bearing 232*c* or an outer diameter of the fixed bearing 232*a*. As such, the eccentric shaft 232*b* may provide a force to compress the refrigerant while orbiting the orbiting scroll 330 when the bearing 232 rotates, and the orbiting scroll 330 may be disposed to regularly orbit the fixed scroll 320 by the eccentric shaft 232*b***.

However, in order to prevent the orbiting scroll 320 from rotating, the compressor 10 may further include an Oldham's ring 340 coupled to an upper portion of the orbiting scroll 320. The Oldham's ring 340 may be disposed between the orbiting scroll 330 and the main frame 310 to be in contact with both the orbiting scroll 330 and the main frame 310. The Oldham's ring 340 may be disposed to linearly move in four directions of front, rear, left, and right directions to prevent the rotation of the orbiting scroll 320.

In some examples, the rotation shaft 230 may be disposed to completely pass through the fixed scroll 320 to protrude out of the compressing assembly 300. In some implementations, the rotation shaft 230 may be in direct contact with outside of the compressing assembly 300 and the oil stored in the sealing shell 130. The rotation shaft 230 may supply the oil into the compressing assembly 300 while rotating.

The oil may be supplied to the compressing assembly 300 through the rotation shaft 230. An oil feed channel 234 for supplying the oil to an outer circumferential surface of the main bearing 232*c*, an outer circumferential surface of the fixed bearing 232*a*, and an outer circumferential surface of the eccentric shaft 232*b* may be formed at or inside the rotation shaft 230.

In addition, a plurality of oil feed holes 234*a*, 234*b*, 234*c*, and 234*d* may be defined in the oil feed channel 234. Specifically, the oil feed hole may include a first oil feed hole 234*a*, a second oil feed hole 234*b*, a third oil feed hole 234*c*, and a fourth oil feed hole 234*d*. First, the first oil feed hole 234*a* may be defined to penetrate through the outer circumferential surface of the main bearing 232*c*.

The first oil feed hole 234*a* may be defined to penetrate into the outer circumferential surface of the main bearing 232*c* in the oil feed channel 234. In addition, the first oil feed hole 234*a* may be defined to, for example, penetrate an upper portion of the outer circumferential surface of the main bearing 232*c*, but is not limited thereto. That is, the first oil feed hole 234*a* may be defined to penetrate a lower portion of the outer circumferential surface of the main bearing 232*c*. For reference, unlike as shown in the drawing, the first oil feed hole 234*a* may include a plurality of holes. In addition, when the first oil feed hole 234*a* includes the plurality of holes, the plurality of holes may be defined only in the upper portion or only in the lower portion of the outer circumferential surface of the main bearing 232*c*, or may be defined in both the upper and lower portions of the outer circumferential surface of the main bearing 232*c*.

In addition, the rotation shaft 230 may include an oil feeder 233 disposed to pass through a muffler 500 to be described later to be in contact with the stored oil of the casing 100. The oil feeder 233 may include an extension shaft 233*a* passing through the muffler 500 and in contact with the oil, and a spiral groove 233*b* spirally defined in an outer circumferential surface of the extension shaft 233*a* and in communication with the oil feed channel 234.

Thus, when the rotation shaft 230 is rotated, due to the spiral groove 233*b*, a viscosity of the oil, and a pressure difference between a high pressure region S1 and an intermediate pressure region V1 inside the compressing assembly 300, the oil rises through the oil feeder 233 and the oil feed channel 234 and is discharged into the plurality of oil feed holes. The oil discharged through the plurality of oil feed holes 234*a*, 234*b*, 234*c*, and 234*d* not only maintains an airtight state by forming an oil film between the fixed scroll 250 and the orbiting scroll 240, but also absorbs frictional heat generated at friction portions between the components of the compressing assembly 300 and discharge the heat.

The oil guided along the rotation shaft 230 and supplied through the first oil feed hole 234*a* may lubricate the main frame 310 and the rotation shaft 230. In addition, the oil may be discharged through the second oil feed hole 234*b* and supplied to a top surface of the orbiting scroll 240, and the oil supplied to the top surface of the orbiting scroll 240 may be guided to the intermediate pressure region through the pocket groove 314. For reference, the oil discharged not only through the second oil feed hole 234*b* but also through the first oil feed hole 234*a* or the third oil feed hole 234*c* may be supplied to the pocket groove 314.

In some examples, the oil guided along the rotation shaft 230 may be supplied to the Oldham's ring 340 and the fixed side plate 322 of the fixed scroll 320 installed between the orbiting scroll 240 and the main frame 310. Thus, wear of the fixed side plate 322 of the fixed scroll 320 and the Oldham's ring 340 may be reduced. In addition, the oil supplied to the third oil feed hole 234*c* is supplied to the compression chamber to not only reduce wear due to friction between the orbiting scroll 330 and the fixed scroll 320, but also form the oil film and discharge the heat, thereby improving a compression efficiency.

Although a centrifugal oil feed structure in which the lower scroll type compressor 10 uses the rotation of the rotation shaft 230 to supply the oil to the bearing has been described, the centrifugal oil feed structure is merely an example. Further, a differential pressure supply structure for supplying oil using a pressure difference inside the compressing assembly 300 and a forced oil feed structure for supplying oil through a toroid pump, and the like may also be applied.

In some examples, the compressed refrigerant is discharged to the discharge hole 326 along a space defined by the fixed wrap 323 and the orbiting wrap 333. The discharge hole 326 may be more advantageously disposed toward the discharger 121. This is because the refrigerant discharged from the discharge hole 326 is most advantageously delivered to the discharger 121 without a large change in a flow direction.

However, because of structural characteristics that the compressing assembly 300 is provided in a direction away from the discharger 121 with respect to the driver 200, and that the fixed scroll 320 should be disposed at an outermost portion of the compressing assembly 300, the discharge hole 326 is disposed to spray the refrigerant in a direction opposite to the discharger 121.

In other words, the discharge hole 326 is defined to spray the refrigerant in a direction away from the discharger 121 with respect to the fixed end plate 321. Therefore, when the refrigerant is sprayed into the discharge hole 326 as it is, the refrigerant may not be smoothly discharged to the discharger 121, and when the oil is stored in the sealing shell 130, the refrigerant may collide with the oil and be cooled or mixed.

In order to prevent this problem, the compressor 10 in accordance with the present disclosure may further include the muffler 500 coupled to an outermost portion of the fixed scroll 320 and providing a space for guiding the refrigerant to the discharger 121.

The muffler 500 may be disposed to seal one surface disposed in a direction farther away from the discharger 121 of the fixed scroll 320 to guide the refrigerant discharged from the fixed scroll 320 to the discharger 121.

The muffler 500 may include a coupling body 520 coupled to the fixed scroll 320 and a receiving body 510 extending from the coupling body 520 to define sealed space therein. Thus, the refrigerant sprayed from the discharge hole 326 may be discharged to the discharger 121 by switching the flow direction along the sealed space defined by the muffler 500.

Further, since the fixed scroll 320 is coupled to the receiving shell 110, the refrigerant may be restricted from flowing to the discharger 121 by being interrupted by the fixed scroll 320. Therefore, the fixed scroll 320 may further include a bypass hole 327 defined therein allowing the refrigerant penetrated the fixed end plate 321 to pass through the fixed scroll 320. The bypass hole 327 may be disposed to be in communication with the main hole 317. Thus, the refrigerant may pass through the compressing assembly 300, pass the driver 200, and be discharged to the discharger 121.

The more the refrigerant flows inward from an outer circumferential surface of the fixed wrap 323, the higher the pressure compressing the refrigerant. Thus, an interior of the fixed wrap 323 and an interior of the orbiting wrap 333 maintain in a high pressure state. Accordingly, a discharge pressure is exerted to a rear surface of the orbiting scroll as it is, and the backpressure is exerted toward the fixed scroll in the orbiting scroll in a reactional manner. The compressor 10 may further include a backpressure seal 350 that concentrates the backpressure on a portion where the orbiting scroll 320 and the rotation shaft 230 are coupled to each other, thereby preventing leakage between the orbiting wrap 333 and the fixed wrap 323.

The backpressure seal 350 is disposed in a ring shape to maintain an inner circumferential surface thereof at a high pressure, and separate an outer circumferential surface thereof at an intermediate pressure lower than the high pressure. Therefore, the backpressure is concentrated on the inner circumferential surface of the backpressure seal 350, so that the orbiting scroll 330 is in close contact with the fixed scroll 320.

In some implementations, considering that the discharge hole 326 is defined to be spaced apart from the rotation shaft 230, the backpressure seal 350 may also be disposed such that a center thereof is biased toward the discharge hole 326.

In addition, due to the backpressure seal 350, the oil supplied from the first oil feed hole 234*a* may be supplied to the inner circumferential surface of the backpressure seal 350. Therefore, the oil may lubricate a contact surface between the main scroll and the orbiting scroll. Further, the oil supplied to the inner circumferential surface of the backpressure seal 350 may generate a backpressure for pushing the orbiting scroll 330 to the fixed scroll 320 together with a portion of the refrigerant.

As such, the compression space of the fixed wrap 323 and the orbiting wrap 333 may be divided into the high pressure region S1 inside the backpressure seal 350 and the intermediate pressure region V1 outside the backpressure seal 350 on the basis of the backpressure seal 350. In some examples, the high pressure region S1 and the intermediate pressure region V1 may be naturally divided because the pressure is increased in a process in which the refrigerant is introduced and compressed. However, since the pressure change may occur critically due to a presence of the backpressure seal 350, the compression space may be divided by the backpressure seal 350.

In some examples, the oil supplied to the compressing assembly 300, or the oil stored in the casing 100 may flow toward an upper portion of the casing 100 together with the refrigerant as the refrigerant is discharged to the discharger 121. In some implementations, because the oil is denser than the refrigerant, the oil may not be able to flow to the discharger 121 by a centrifugal force generated by the rotor 220, and may be attached to inner walls of the discharge shell 120 and the receiving shell 110. The lower scroll type compressor 10 may further include collection channels respectively on outer circumferential faces of the driver 200 and the compressing assembly 300 to collect the oil attached to an inner wall of the casing 100 to the oil storage space of the casing 100 or the sealing shell 130.

The collection channel may include a driver collection channel 201 defined in an outer circumferential surface of the driver 200, a compressor collection channel 301 defined in an outer circumferential surface of the compressing assembly 300, and a muffler collection channel 501 defined in an outer circumferential surface of the muffler 500.

The driver collection channel 201 may be defined by recessing a portion of an outer circumferential surface of the stator 210 is recessed, and the compressor collection channel 301 may be defined by recessing a portion of an outer circumferential surface of the fixed scroll 320. In addition, the muffler collection channel 501 may be defined by recessing a portion of the outer circumferential surface of the muffler. The driver collection channel 201, the compressor collection channel 301, and the muffler collection channel 501 may be defined in communication with each other to allow the oil to pass therethrough.

As described above, because the rotation shaft 230 has a center of gravity biased to one side due to the eccentric shaft 232*b*, during the rotation, an unbalanced eccentric moment occurs, causing an overall balance to be distorted. Accordingly, the lower scroll type compressor 10 may further include a balancer 400 that may offset the eccentric moment that may occur due to the eccentric shaft 232*b*.

Because the compressing assembly 300 is fixed to the casing 100, the balancer 400 is preferably coupled to the rotation shaft 230 itself or the rotor 220 disposed to rotate. Therefore, the balancer 400 may include a central balancer 410 disposed on a bottom of the rotor 220 or on a surface facing the compressing assembly 300 to offset or reduce an eccentric load of the eccentric shaft 232*b*, and an outer balancer 420 coupled to a top of the rotor 220 or the other surface facing the discharger 121 to offset an eccentric load or an eccentric moment of at least one of the eccentric shaft 232*b* and the outer balancer 420.

Because the central balancer 410 is disposed relatively close to the eccentric shaft 232*b*, the central balancer 410 may directly offset the eccentric load of the eccentric shaft 232*b*. Accordingly, the central balancer 410 is preferably disposed eccentrically in a direction opposite to the direction in which the eccentric shaft 232*b* is eccentric. In some implementations, even when the rotation shaft 230 rotates at a low speed or a high speed, because a distance away from the eccentric shaft 232*b* is close, the central balancer 410 may effectively offset an eccentric force or the eccentric load generated in the eccentric shaft 232*b* almost uniformly.

The outer balancer 420 may be disposed eccentrically in a direction opposite to the direction in which the eccentric shaft 232*b* is eccentric. However, the outer balancer 420 may be eccentrically disposed in a direction corresponding to the eccentric shaft 232*b* to partially offset the eccentric load generated by the central balancer 410.

In some implementations, the central balancer 410 and the outer balancer 420 may offset the eccentric moment generated by the eccentric shaft 232*b* to assist the rotation shaft 230 to rotate stably.

In some examples, the compressor 10 in accordance with one implementation may include a separator 600 configured to separate the oil from the refrigerant supplied into a space between the driver 200 and the discharger 121.

The separator 800 may be coupled to the driver 200 and may be configured to rotate together with the rotation shaft 230 when the rotation shaft 230 rotates. Specifically, the separator 800 may be coupled to the rotation shaft 230. The separator 600 may be coupled to the rotation shaft 230 so that a center of rotation of the separator 600 coincides with that of the rotation shaft 230.

The separator 600 rotates at high speed when the rotation shaft 230 rotates. Thus, the separator 600 may provide strong centrifugal force to the refrigerant and oil around the separator 600. The refrigerant is relatively less dense than the oil and may not be significantly affected by the centrifugal force generated from the separator 600. That is, the centrifugal force acting on the refrigerant is smaller than a pressure difference between the inside and the outside of the discharger 121. Thus, the refrigerant may be discharged to the discharger 121 without being affected by the separator 600 (I direction). However, the oil is denser than the refrigerant. When the oils collide with each other, the oil may grow into large droplets. Therefore, the centrifugal force generated by the separator 600 may affect the oil in a greater degree than the refrigerant, so that the oils collide with each other in the vicinity of the separator 600 to grow into the droplets which then may impinge on the casing 100 and may be collected into the oil reservoir through the collection channel (II direction).

In some examples, as the oil passing through the separator 600 becomes denser, the oil may not be discharged to the discharger 121 and rather may be stored inside the separator 600. The stored oil in the separator may be discharged to the inner wall of the casing 100 using the centrifugal force of the separator 600 and may be collected back into the oil reservoir.

In some examples, the higher a flow velocity of the oil and refrigerant, the greater the effect of the centrifugation force by the separator 600 thereto. Therefore, the higher the flow velocity of the oil and refrigerant supplied to the separator 600, the more advantageous. However, even when the flow velocity of the oil and refrigerant discharged from the compressing assembly 300 is high, the oil and refrigerant may be first rubbed against the components while passing through the bypass hole 327 and the main hole 317 of the compressing assembly 300. Further, the oil and refrigerant may be second rubbed against the stator 210 and the rotor 220 while passing through a space between the stator 210 and the rotor 220 or passing through the rotor 220. Further, the oil and refrigerant may be third rubbed against the balancer 400 as they collide with the balancer 400. In some implementations, the oil and refrigerant may lose energy in the rubbing process and thus the flow velocity thereof may be reduced. Accordingly, the separation efficiency of separating the oil from the refrigerant using the separator 600 may be reduced.

In some examples, regardless of the presence of the separator 600, the energy of the refrigerant as generated when the refrigerant is sufficiently compressed in the compressing assembly 300 may be lost in a heat form during the friction thereof with the compressing assembly 300 or the driver 200 placed inside the casing. Thus, the compressor performance (COP) may be reduced. In some implementations, the compressing assembly 300 may include a main frame 310, a fixed scroll 320, and an orbiting scroll 330 engaged with the fixed scroll 320 and configured to rotate relative to the fixed scroll 320. In some examples, the orbiting scroll 330 may be coupled to the rotation shaft 230 and accommodated between the main frame 310 and the fixed scroll 330.

In some implementations, the compressor 10 may further include a bypassing portion 900 configured outside the casing to deliver the refrigerant or the oil discharged to the muffler 500 to the discharger 121.

Figure 3:
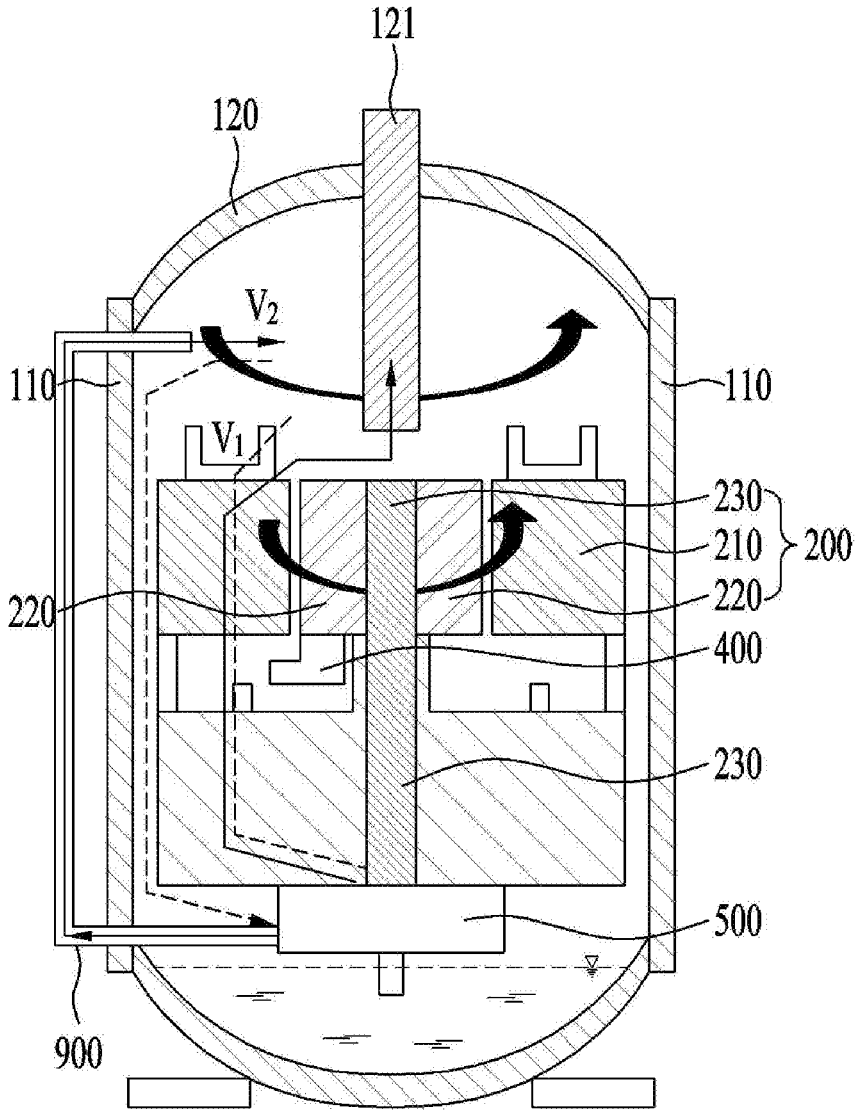
FIG. 3 illustrates an example of a conceptual diagram of the compressor.

FIG. 3 illustrates an example of a schematic diagram of the bypassing portion 900 installed onto the compressor 10.

The bypassing portion 900 may be configured to immediately communicate the muffler 500 and the casing 100. In other words, the bypassing portion 900 has one end combined with the muffler 500 and the other end combined with the casing 100 placed between the driver 200 and the discharger 121. The bypassing portion 900 may be embodied as a pipe or may be embodied in a form of a duct. That is, the bypassing portion 900 may be embodied in any form as long as it may transfer the oil and refrigerant to the casing 100 where the discharger 121 is located. As such, the bypassing portion 900 may be configured to supply the refrigerant discharged to the muffler 500 to at least one of the separator 600 or the discharger 121.

The refrigerant compressed due to the rotation of the rotation shaft 230 and the oil are discharged from the compressing assembly 300 toward the muffler 500. The muffler 500 may feed the refrigerant as compressed and the oil through the driver 200 to the discharger 121 through the bypass and main holes. Further, the refrigerant or oil discharged to the muffler 500 may flow along the bypassing portion 900 and be fed to the discharger 121.

In some implementations, the flow velocity V2 of the oil and refrigerant passing through the bypassing portion 900 may be higher than the flow velocity V1 of the refrigerant and oil passing through the driver 200. Thus, the oil and refrigerant passing through the bypassing portion 900 may be separated from with each other using the separator 600 more efficiently than the oil and refrigerant passing through the driver 200 are separated from each other. Therefore, the oil separation efficiency is improved, so that a larger amount of the oil may be collected into the storage space of the casing 100. The amount of the oil leaking into the discharger 121 may decrease. Therefore, since the compressing assembly 300 may always be lubricated or cooled with a sufficient amount of the oil, the stability and reliability of the compressor 10 may be increased.

Further, the higher flow velocity of the oil and refrigerant may mean the less heat loss and friction loss. In other words, the refrigerant supplied through the bypassing portion 900 may maintain more energy than the refrigerant supplied through the driver 200. Therefore, the refrigerant passing through the bypassing portion 900 may be more efficient for operation of the compressor than the refrigerant passing through the driver 200.

In some examples, when the bypassing portion 900 is installed onto the compressor 10, the driver 200 or the compressing assembly 300 may not have a channel for transferring the refrigerant or the oil toward the discharger 121. For example, the bypass hole 327 or the main hole 317 may be omitted. That is, the refrigerant compressed in the compressing assembly 300 may be discharged to the discharger 121 only through the bypassing portion 900.

In another example, in order to achieve the effect of cooling the driver 200 and compressing assembly 300 using the refrigerant or oil, the bypass hole 327 or the main hole 317 may be maintained.

Figure 4:
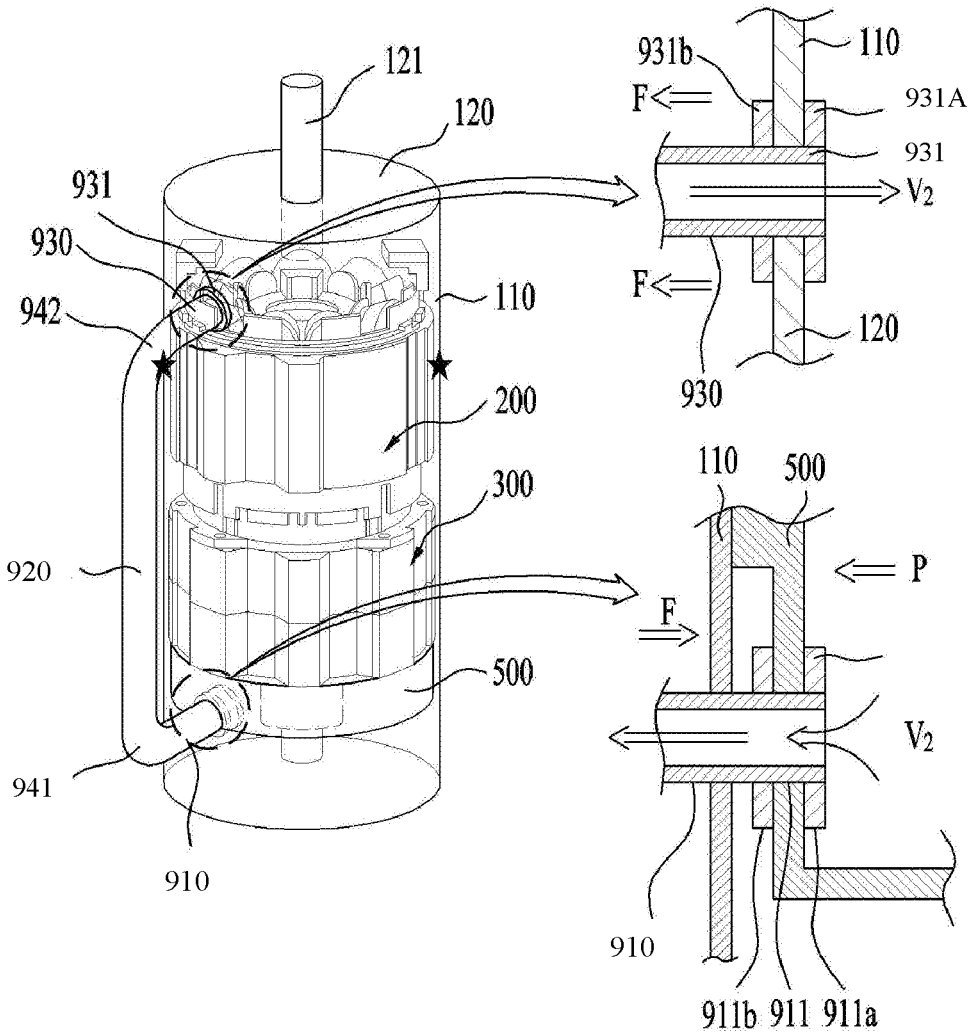
FIG. 4 illustrates an example of a bypassing portion or an external pipe.

Referring to FIG. 4, the bypassing portion 900 may include a first pipe 910 coupled to the muffler, a second pipe 920 configured to communicate with the first pipe and extending toward the discharger outside of the casing, and a third pipe 930 configured to communicate with the second pipe and coupled to the casing.

The first pipe 910 may be configured to pass through the receiving shell 110 and communicate with the muffler 500, and may be configured to penetrate the muffler 500. The second pipe 920 may be configured to extend from one end or a downstream side of the first pipe 910 in the longitudinal direction of the rotation shaft 230. The second pipe 920 may extend in a parallel manner to the rotation shaft 230, or may extend obliquely relative to the rotation shaft 230 or may extend to have a certain curvature. The second pipe 920 may extend to one end of the receiving shell 110 or the discharge shell 120. The third pipe 930 may be configured to extend from one end or a downstream side of the second pipe 920 and penetrate the receiving shell 110 or the discharge shell 120.

In some examples, a high pressure refrigerant or oil may be discharged from the fixed scroll 320 to the muffler 500, so that the interior of the muffler 500 may be at a high pressure. In this case, there is no problem when the first pipe 910 is integrated with the muffler 500. However, when the first pipe 910 passes through the muffler 500 and is coupled thereto or is coupled to an outer circumferential surface of the muffler 500, the pressure P pushes the first pipe 910 outwardly strongly. Thus, the pressure P may weaken the coupling between the first pipe 910 and the muffler 500. In severe cases, the first pipe 910 may be unintentionally separated from the muffler 500.

In some implementations, the bypassing portion 900 may further include a muffler fastener 911 that combines a distal end of the first pipe 910 with the muffler 500. The muffler fastener 911 may include a first seat 911*a* that extends from an outer circumferential surface of the first pipe 910 or is coupled to the first pipe 910 and is seated on an inner wall of the muffler. Thus, even when the pressure P acts on the first pipe 910, the coupling between the first pipe 910 and the muffler 500 may increase since the first seat 911*a* is more tightly attached to the inner wall of the muffler 500.

In some examples, a reaction force F generated when the refrigerant or oil flowing through the first pipe 910 is discharged may act on the first pipe 910. In some implementations, the reaction force F may insert the first pipe 910 to the muffler 500.

In some implementations, the muffler fastener 911 may include a first close contact portion 911*b* extending from the outer circumferential surface to the first pipe or coupled to the first pipe and seated on the outer wall of the muffler. The close contact portion 911*b* prevents the first pipe 910 from entering the muffler 500 or from breaking even at any flow velocity or amount of the refrigerant and oil.

In some examples, the muffler fastener 911 ensures the durability of the first pipe 9100 even when the vibration or shock is transmitted to the first pipe 910.

In some cases, when a large amount of the refrigerant or oil is discharged at the flow velocity of V2 from the third pipe 930, a reaction force F may occur and may act on the third pipe. Further, sufficient supply of the refrigerant and oil into the space between the driver 200 and the discharger 121 may result in a significantly higher pressure in the space than a pressure external to the casing 100. Thus, a force for separating the third pipe 930 from the casing 100 may be further amplified. Therefore, there is a risk that the third pipe 930 and the casing 100 may be separated from each other.

In some implementations, the bypassing portion 900 may include a casing fastener 931 that combines a distal end of the third pipe with the casing. The casing fastener 931 may include a third seat 931*a* extending from the outer circumferential surface of the third pipe 930 or coupled to the third pipe and seated on the inner wall of the casing. Thus, the casing fastener 931 may tightly couple the third pipe 930 to the casing 100.

Further, the casing fastener 931 may include a third close contact portion 931*b* extending from the outer circumferential surface of the third pipe 930 or coupled to the third pipe and seated on the outer wall of the casing. Thus, the possibility of the third pipe 930 being introduced into the casing 100 may be reduced.

In some examples, when a fluid flow direction in the first pipe, the second pipe and the third pipe of the bypassing portion 900 changes drastically, flow loss may occur in the refrigerant or oil passing through the bypassing portion 900. Thus, to prevent this situation, the first pipe 910 may further include a first connection pipe 941 configured to extend in an inclined manner toward the discharger 121 and connected to the second pipe. The third pipe 930 may further include a second connection pipe 942 configured to extend in an inclined manner toward the casing from a distal end of the second pipe.

Each of the first connection pipe 941 and the second connection pipe 942 may be bent. The first connection pipe 941 and the second connection pipe 942 may have smaller diameters than those of the first pipe and the third pipe respectively. Further, the first connection pipe 941 and the second connection pipe 942 are configured to be stretchable and retractable to improve the shock resistance of the bypassing portion 900.

Figure 5:
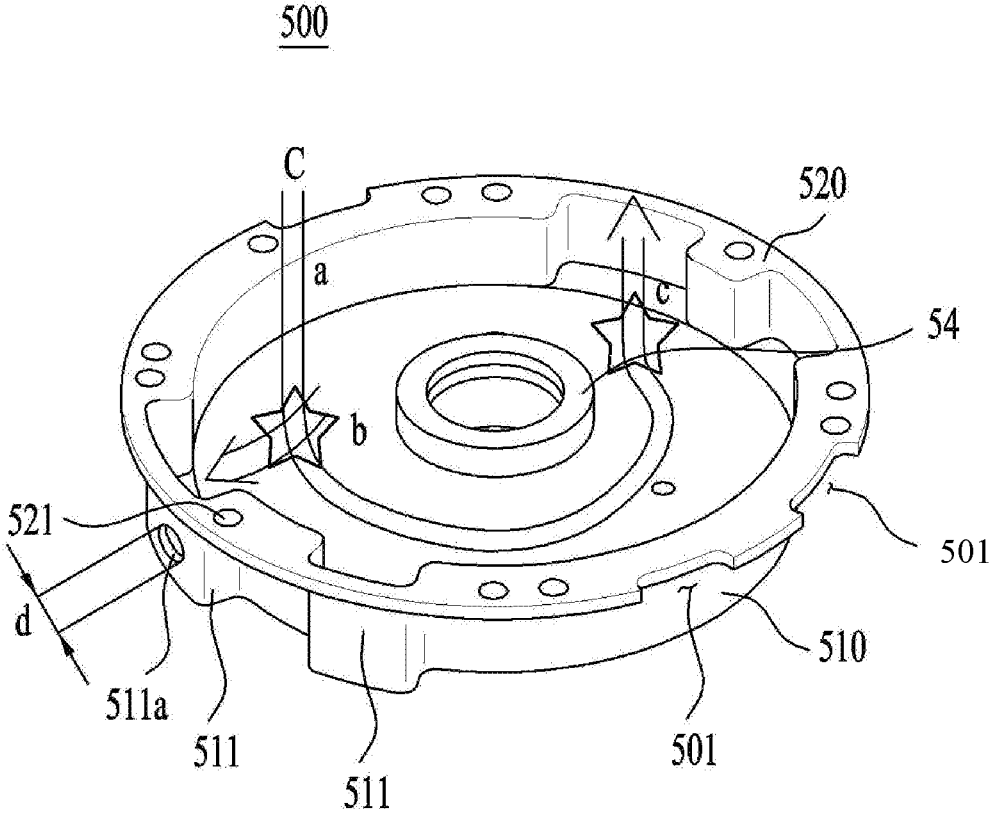
FIG. 5 illustrates an example of a muffler.

FIG. 5 illustrates an example structure of the muffler 500 of a compressor.

The receiving body 510 of the muffler 500 may include an outlet hole 511*a* through which the refrigerant is discharged into the first pipe.

The receiving body 510 may further include a guide 511 configured to protrude outwardly to guide the refrigerant discharged from the compressing assembly 300 to the discharger 121. That is, the guide 511 may be configured to protrude outwardly of the receiving body 510 to communicate with the bypass hole 327.

When the guide 511 is present on the outer surface of the receiving body 510, the refrigerant collides with the guide 511 and then discharged into the outlet hole 511*a*. Thus, the kinetic energy of the refrigerant may be lost. Therefore, it may be desirable for the outlet hole 511*a* to pass through the guide 511.

The refrigerant RE discharged from the compressing assembly 300 impinges on the receiving body 510 of the muffler 500, and then, due to the guide 511, a portion of the refrigerant may be sprayed toward the bypass hole 327 and the other portion thereof may be delivered to the bypassing portion 900 through the outlet hole 511*a*. A diameter of the outlet hole 511*a* may correspond to the diameter of the first pipe 910. In some implementations, the outlet hole 511*a* may include a plurality of outlet holes. In this case, the bypassing portion 900 should include a plurality of bypassing portion.

The coupling body 520 may further include a muffler collection channel 501 defined by cutting a portion of an outer circumferential surface thereof. The oil separated from the refrigerant maybe collected through the muffler collection channel 501 into the space in which the oil is stored. The muffler collection channel 501 may be defined at a position corresponding to a position of each of the driver collection channel 201 and the compressing assembly collection channel 301.

In some implementations, the outlet hole 511*a* may be defined in the receiving body so as to bypass the muffler collection channel. The bypassing portion 900 is coupled to the outlet hole 511*a* and extends. This prevents the bypassing portion 900 from interfering with the oil collection.

Figure 6A:
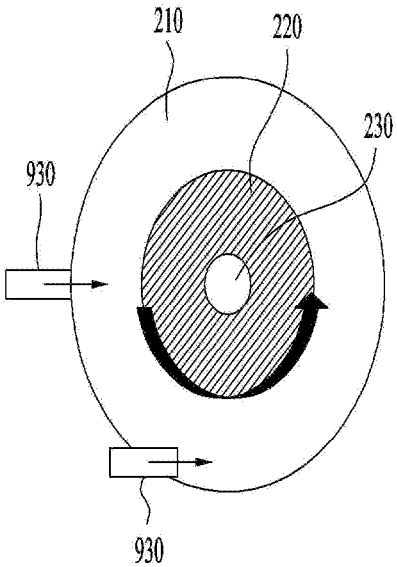
FIGS. 6A and 6B illustrate examples coupling locations between a bypassing portion and a casing.
Figure 6B:
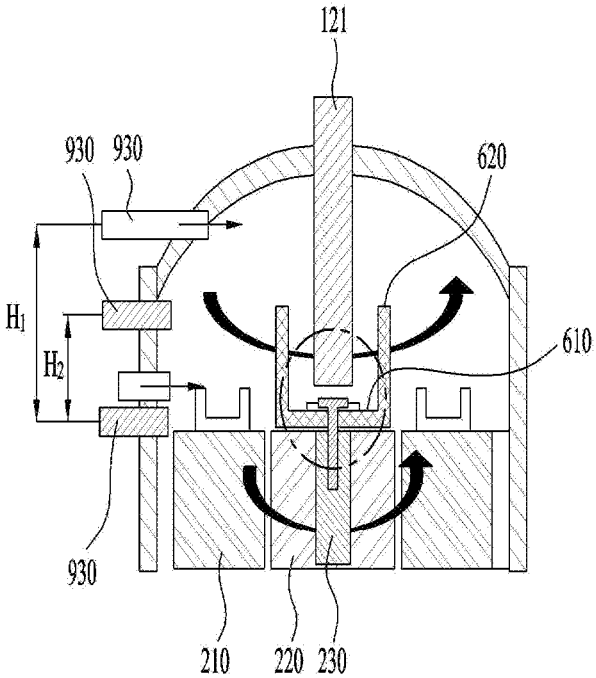

FIGS. 6A and 6B illustrate example locations where the third pipe is coupled to the casing in the compressor.

Referring to FIG. 6A, the third pipe 930 may be coupled to the outer circumferential surface of the casing via the casing fastener 931 as described above. The third pipe 930 may be coupled to the casing so that the refrigerant or oil is discharged in a direction between a radial direction toward the rotation shaft 230 and a tangential direction with the outer circumferential surface of the casing. As the refrigerant and oil travels around the inner circumferential surface of the casing 100, this may increase the oil separation efficiency using the separator 600. Thus, the third pipe 930 may be configured to eject the refrigerant or oil in the direction as close as possible to the tangential direction with the casing. For this purpose, the third pipe 930 may be coupled to a position closer to a lateral surface of the casing rather than a center of the casing 100.

Referring to FIG. 6B, the third pipe 930 may be configured to be coupled to the casing so that the refrigerant or oil is discharged into a level between a level of the driver 200 and a level of the casing 100 at which the discharger 121 is coupled to the casing 100 (H1). The third pipe 930 is configured to supply the refrigerant and oil to the separator 600 or to supply the refrigerant and oil to the discharger 121.

The separator 600 may include a coupling body 610 and an extending body 620 extending from the coupling body 610 in a direction corresponding to the longitudinal direction of the rotation shaft. In some implementations, the third pipe 930 may be configured to be coupled with the casing to discharge the refrigerant or oil into a space between the driver 200 and an free end of the separator 600 (H2). Since a portion for generating the centrifugal force capable of separating the refrigerant and oil from each other is a distal end or a free end of the extending body 620, the third pipe 930 may be configured to discharge the refrigerant or oil into a vertical level between the coupling body 610 and the extending body 620 (H2). When the separator 600 is omitted, the third pipe 930 may be configured to inject the refrigerant into a vertical level (H1) between the discharger 121 and a level where the driver 200 is installed.

In some implementations, the bypassing portion 900 is preferably configured to supply the refrigerant and oil in a direction away from the rotation shaft 230 in order that the oil is smoothly separated from the refrigerant. That is, the bypassing portion 900 may be configured to supply the refrigerant or oil to the inner wall of the casing closest to the bypassing portion 900.

In some examples, the bypassing portion 900 may be configured to inject the oil and refrigerant into a position between a portion of the driver 200 at which the driver 200 is exposed inwardly of the casing 100 and the discharge shell 120 in order that the oil is smoothly separated from the refrigerant. In order to maximize the oil separation efficiency using the separator 600, the bypassing portion 900 is preferably configured to supply the refrigerant and oil into a vertical level corresponding to a vertical level of the separator 600.

Figure 7A:
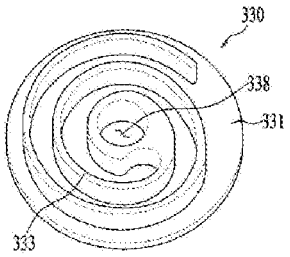
FIGS. 7A to 7C illustrate an example of operation of a compressor that compresses refrigerant.
Figure 7B:
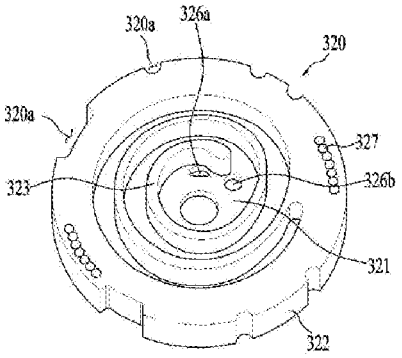
Figure 7C:
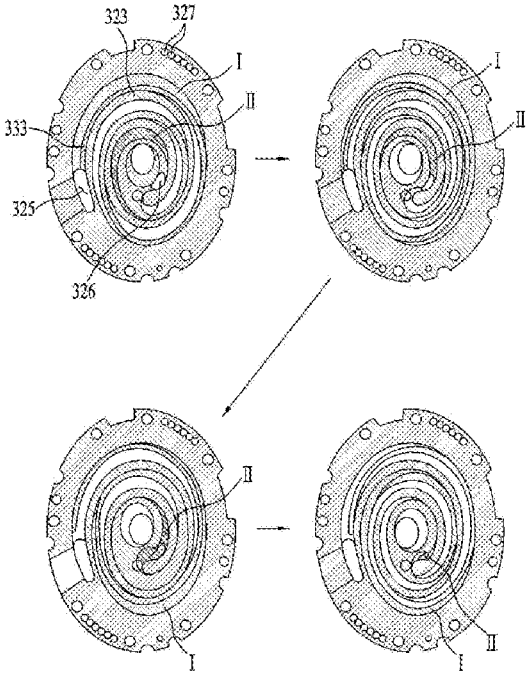

FIGS. 7A to 7C illustrate an operating aspect of the scroll type compressor.

FIG. 7A illustrates an example orbiting scroll, FIG. 7B illustrates an example fixed scroll, and FIG. 7C illustrates an example process in which the orbiting scroll and the fixed scroll compress the refrigerant.

The orbiting scroll 330 may include the orbiting wrap 333 on one surface of the orbiting end plate 331, and the fixed scroll 320 may include the fixed wrap 323 on one surface of the fixed end plate 321.

In addition, the orbiting scroll 330 is provided as a sealed rigid body to prevent the refrigerant from being discharged to the outside, but the fixed scroll 320 may include the inflow hole 325 in communication with a refrigerant supply pipe such that the refrigerant in a liquid phase of a low temperature and a low pressure may inflow, and the discharge hole 326 through which the refrigerant of a high temperature and a high pressure is discharged. Further, the bypass hole 327 through which the refrigerant discharged from the discharge hole 326 is discharged may be defined in an outer circumferential surface of the fixed scroll 320.

In some examples, the fixed wrap 323 and the orbiting wrap 333 may be formed in an involute shape and at least two contact points between the fixed wrap 323 and the orbiting wrap 333 may be formed, thereby defining the compression chamber.

The involute shape refers to a curve corresponding to a trajectory of an end of a yarn when unwinding the yarn wound around a base circle having an arbitrary radius as shown.

However, in accordance with the present disclosure, the fixed wrap 323 and the orbiting wrap 333 are formed by combining 20 or more arcs, and radii of curvature of the fixed wrap 323 and the orbiting wrap 333 may vary from part to part.

That is, the compressor accordance with the present disclosure is configured such that the rotation shaft 230 penetrates the fixed scroll 320 and the orbiting scroll 330, and thus the radii of curvature of the fixed wrap 323 and the orbiting wrap 333 and the compression space are reduced.

Thus, in order to compensate for this reduction, in the compressor in accordance with the present disclosure, radii of curvature of the fixed wrap 323 and the orbiting wrap 333 immediately before the discharge may be smaller than that of the penetrated shaft receiving portion of the rotation shaft such that the space to which the refrigerant is discharged may be reduced and a compression ratio may be improved.

That is, the fixed wrap 323 and the orbiting wrap 333 may be more severely bent in the vicinity of the discharge hole 326, and may be more bent toward the inflow hole 325, so that the radii of curvature of the fixed wrap 323 and the orbiting wrap 333 may vary point to point in correspondence with the bent portions.

Referring to FIG. 7C, refrigerant I is flowed into the inflow hole 325 of the fixed scroll 320, and refrigerant II flowed before the refrigerant I is located near the discharge hole 326 of the fixed scroll 320.

In this case, the refrigerant I is present in a region at outer circumferential faces of the fixed wrap 323 and the orbiting wrap 333 where the fixed wrap 323 and the orbiting wrap 333 are engaged with each other, and the refrigerant II is enclosed in another region in which the two contact points between the fixed wrap 323 and the orbiting wrap 333 exist.

Thereafter, when the orbiting scroll 330 starts to orbit, as the region in which the two contact points between the fixed wrap 323 and the orbiting wrap 333 exist is moved based on a position change of the orbiting wrap 333 along an extension direction of the orbiting wrap 333, a volume of the region begins to be reduced, and the refrigerant I starts to flow and be compressed. The refrigerant II starts to be further reduced in volume, be compressed, and guided to the discharge hole 326.

The refrigerant II is discharged from the discharge hole 326, and the refrigerant I flows as the region in which the two contact points between the fixed wrap 323 and the orbiting wrap 333 exist moves in a clockwise direction, and the volume of the refrigerant I decreases and starts to be compressed more.

As the region in which the two contact points between the fixed wrap 323 and the orbiting wrap 333 exist moves again in the clockwise direction to be closer to an interior of the fixed scroll, the volume of the refrigerant I further decreases and the refrigerant II is almost discharged.

As such, as the orbiting scroll 330 orbits, the refrigerant may be compressed linearly or continuously while flowing into the fixed scroll.

Although the drawing shows that the refrigerant flows into the inflow hole 325 discontinuously, this is for illustrative purposes only, and the refrigerant may be supplied continuously. In some examples, the refrigerant may be accommodated and compressed in each region where the two contact points between the fixed wrap 323 and the orbiting wrap 333 exist.

Effects as not described herein may be derived from the above configurations. The relationship between the above-described components may allow a new effect not seen in the conventional approach to be derived.

In addition, implementations shown in the drawings may be modified and implemented in other forms. The modifications should be regarded as falling within a scope when the modifications is carried out so as to include a component claimed in the claims or within a scope of an equivalent thereto.

What is claimed is:

1. A compressor comprising:

a casing that defines a reservoir space configured to store oil, the casing comprising a discharger disposed at a side of the casing and configured to discharge refrigerant;

a driver comprising:

a stator coupled to an inner circumferential surface of the casing and configured to generate a rotating magnetic field, and a rotor accommodated in the stator and configured to rotate relative to the stator based on the rotating magnetic field;

a rotation shaft that is coupled to the rotor and that extends in a direction away from the discharger;

a compressing assembly that is coupled to the rotation shaft, that is configured to be lubricated with the oil, and that is configured to compress the refrigerant and discharge the compressed refrigerant in the direction away from the discharger;

a muffler coupled to the compressing assembly and configured to guide the refrigerant to the discharger;

a bypassing portion configured to transfer the refrigerant or the oil from the muffler to the discharger; and a separator that is disposed between the discharger and the driver and that is configured to separate the oil from the refrigerant supplied to the discharger, wherein the bypassing portion is configured to supply the refrigerant or the oil from the muffler to at least one of the separator or the discharger, and wherein the bypassing portion is coupled to an outer circumferential surface of the casing and configured to discharge the refrigerant or the oil to a position between (i) a radial line that extends from the outer circumferential surface of the casing to the rotation shaft and (ii) a tangential line that is tangential to the outer circumferential surface of the casing.

2. The compressor of claim 1, wherein the bypassing portion is coupled to the casing and configured to discharge the refrigerant or the oil into a position between a vertical level of the driver and a vertical level of the side of the casing at which the discharger is coupled.

3. The compressor of claim 2, wherein the bypassing portion is coupled to the casing and configured to discharge the refrigerant or the oil into a space between the driver and a free end of the separator.

4. The compressor of claim 1, wherein the muffler is configured to receive the refrigerant or the oil through the compressing assembly and the driver and to supply the refrigerant or the oil to the bypassing portion.

5. The compressor of claim 1, wherein the bypassing portion comprises:

a first pipe coupled to the muffler;

a second pipe that is in communication with the first pipe, that is disposed outside of the casing, and that extends to the discharger; and a third pipe that is in communication with the second pipe and that is coupled to the casing.

6. The compressor of claim 5, wherein the first pipe passes through the casing.

7. The compressor of claim 6, wherein the bypassing portion further comprises a muffler fastener that couples a distal end of the first pipe to the muffler.

8. The compressor of claim 7, wherein the muffler fastener comprises a seat that is in contact with an inner wall of the muffler and that extends from an outer circumferential surface of the first pipe or is coupled to the first pipe.

9. The compressor of claim 7, wherein the muffler fastener comprises a close contact portion that is in contact with an outer wall of the muffler and that extends from an outer circumferential surface of the first pipe or is coupled to the first pipe.

10. The compressor of claim 7, wherein the muffler fastener comprises:

a seat that is in contact with an inner wall of the muffler and that extends from an outer circumferential surface of the first pipe or is coupled to the first pipe; and a close contact portion that is in contact with an outer wall of the muffler and that extends from the outer circumferential surface of the first pipe or is coupled to the first pipe.

11. The compressor of claim 5, wherein the muffler comprises:

a receiving body that defines a refrigerant flow space therein configured to receive the refrigerant and that defines an outlet hole configured to discharge the refrigerant to the first pipe; and a coupling body that extends along an outer circumferential surface of the receiving body and that is coupled to the compressing assembly.

12. The compressor of claim 11, wherein the receiving body comprises a guide that protrudes radially outward from the outer circumferential surface of the receiving body and that is configured to guide the refrigerant discharged from the compressing assembly to the discharger, and wherein the outlet hole passes through the guide.

13. The compressor of claim 11, wherein the coupling body defines a muffler collection channel that is recessed from an outer circumferential surface of the coupling body and that is configured to discharge the oil separated from the refrigerant toward the reservoir space, and wherein the outlet hole is offset from the muffler collection channel and configured to discharge the refrigerant bypassing the muffler collection channel.

14. The compressor of claim 5, wherein the bypassing portion further comprises a casing fastener that couples a distal end of the third pipe to the casing.

15. The compressor of claim 14, wherein the casing fastener comprises a seat that is in contact with an inner wall of the casing and that extends from an outer circumferential surface of the third pipe or is coupled to the third pipe.

16. The compressor of claim 14, wherein the casing fastener comprises a close contact portion that is in contact with an outer wall of the casing and that extends from an outer circumferential surface of the third pipe or is coupled to the third pipe.

17. The compressor of claim 14, wherein the casing fastener comprises:

a seat that is in contact with an inner wall of the casing and that extends from an outer circumferential surface of the third pipe or is coupled to the third pipe; and a close contact portion that is in contact with an outer wall of the casing and that extends from the outer circumferential surface of the third pipe or is coupled to the third pipe.

18. The compressor of claim 17, wherein the bypassing portion further comprises:

a first connection pipe that extends from the first pipe, that is inclined with respect to the first pipe toward the discharger, and that is connected to the second pipe; and a second connection pipe that extends from a distal end of the second pipe, that is inclined with respect to the second pipe toward the casing, and that is connected to the third pipe.

* * * * *